US008555646B2

(12) United States Patent
Stevenson et al.

(10) Patent No.: US 8,555,646 B2
(45) Date of Patent: Oct. 15, 2013

(54) ANNULAR FUEL AND AIR CO-FLOW PREMIXER

(75) Inventors: Christian Xavier Stevenson, Inman, SC (US); Patrick Benedict Melton, Horse Shoe, NC (US); William David York, Greer, SC (US)

(73) Assignee: General Electric Company, Schenectady, NY (US)

( * ) Notice: Subject to any disclaimer, the term of this patent is extended or adjusted under 35 U.S.C. 154(b) by 786 days.

(21) Appl. No.: 12/360,449

(22) Filed: Jan. 27, 2009

(65) Prior Publication Data

US 2010/0186412 A1 Jul. 29, 2010

(51) Int. Cl.
*F02C 3/20* (2006.01)

(52) U.S. Cl.
USPC ..... 60/737; 60/738; 60/740; 60/742; 60/748

(58) Field of Classification Search
USPC ..... 60/737, 738, 740, 742, 748, 772
See application file for complete search history.

(56) References Cited

U.S. PATENT DOCUMENTS 3,980,233 A * 9/1976 Simmons et al. ..... 239/400
4,285,664 A 8/1981 Voorheis
5,351,477 A * 10/1994 Joshi et al. ..... 60/39.463
5,778,676 A * 7/1998 Joshi et al. ..... 60/746
6,161,387 A * 12/2000 Green ..... 60/748
6,301,899 B1 10/2001 Dean et al.
6,460,326 B2 * 10/2002 Bechtel et al. ..... 60/39.465
6,691,516 B2 * 2/2004 Stuttaford et al. ..... 60/737
6,993,916 B2 2/2006 Johnson et al.
7,007,477 B2 * 3/2006 Widener ..... 60/737
2006/0021350 A1 * 2/2006 Sanders ..... 60/743

OTHER PUBLICATIONS

Search Report and Written Opinion from EP Application No. 09176672.5 dated May 10, 2012.

* cited by examiner

*Primary Examiner* — Phutthiwat Wongwian
*Assistant Examiner* — Steven Sutherland
(74) *Attorney, Agent, or Firm* — Cantor Colburn LLP

(57) ABSTRACT

Disclosed is a premixer for a combustor including an annular outer shell and an annular inner shell. The inner shell defines an inner flow channel inside of the inner shell and is located to define an outer flow channel between the outer shell and the inner shell. A fuel discharge annulus is located between the outer flow channel and the inner flow channel and is configured to inject a fuel flow into a mixing area in a direction substantially parallel to an outer airflow through the outer flow channel and an inner flow through the inner flow channel. Further disclosed are a combustor including a plurality of premixers and a method of premixing air and fuel in a combustor.

18 Claims, 5 Drawing Sheets

ANNULAR FUEL AND AIR CO-FLOW PREMIXER

STATEMENT REGARDING GOVERNMENT INTEREST

This invention was made with United States Government support under Contract No. DE-FC26-05NT42643 awarded by the Department of Energy. The Government has certain rights in the invention.

BACKGROUND OF THE INVENTION

The subject invention relates generally to combustors. More particularly, the subject invention relates to fuel nozzle fuel and air premixers.

Combustors typically include one or more fuel nozzles that introduce a fuel or a mixture of fuel and air to a combustion chamber where it is ignited. Mixing of fuel and air prior to combustion allows for lower flame temperatures than at a stoichiometric condition, resulting in a reduction of nitrogen oxide ($NO_x$) emissions. Typically, fuel flows through a nozzle and fuel jets are injected into a cross flow of air flowing axially along the nozzle. Injecting fuel into the cross flow, however, produces low speed recirculation zones of fuel-air mix downstream of the fuel jets. With many fuels having high flame speeds and short blow off times, such as fuels that are high in $H_2$ content, flameholding is likely to occur in the recirculation zones, resulting in damage to the nozzle and other combustor components. A fuel nozzle premixer that reduces flow anomalies such as recirculation would be well received in the art.

BRIEF DESCRIPTION OF THE INVENTION

According to one aspect of the invention, a premixer for a combustor includes an annular outer shell and an annular inner shell. The inner shell defines an inner flow channel inside of the inner shell and is located to define an outer flow channel between the outer shell and the inner shell. A fuel discharge annulus is located between the outer flow channel and the inner flow channel and is configured to inject a fuel flow into a mixing area in a direction substantially parallel to an outer airflow through the outer flow channel and an inner flow through the inner flow channel.

According to another aspect of the invention, a combustor for a turbomachine includes a plurality of premixers. Each premixer includes an annular outer shell and an annular inner shell defining an inner flow channel inside of the inner shell and located to define an outer flow channel between the outer shell and the inner shell. A fuel discharge annulus is located between the outer flow channel and the inner flow channel and is configured to inject a fuel flow into a mixing area in a direction substantially parallel to an outer airflow through the outer flow channel and an inner flow through the inner flow channel.

According to yet another aspect of the invention, a method of premixing air and fuel in a combustor includes flowing an outer airflow along an outer airflow channel toward a mixing area. An inner airflow is flowed along an inner airflow channel toward the mixing area. Fuel is injected into the mixing area from a fuel discharge annulus located between the inner airflow channel and the outer airflow channel. The fuel is injected into the mixing area in a direction substantially parallel to the inner airflow and the outer airflow. The inner airflow, the outer airflow, and the fuel are mixed in the mixing area.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
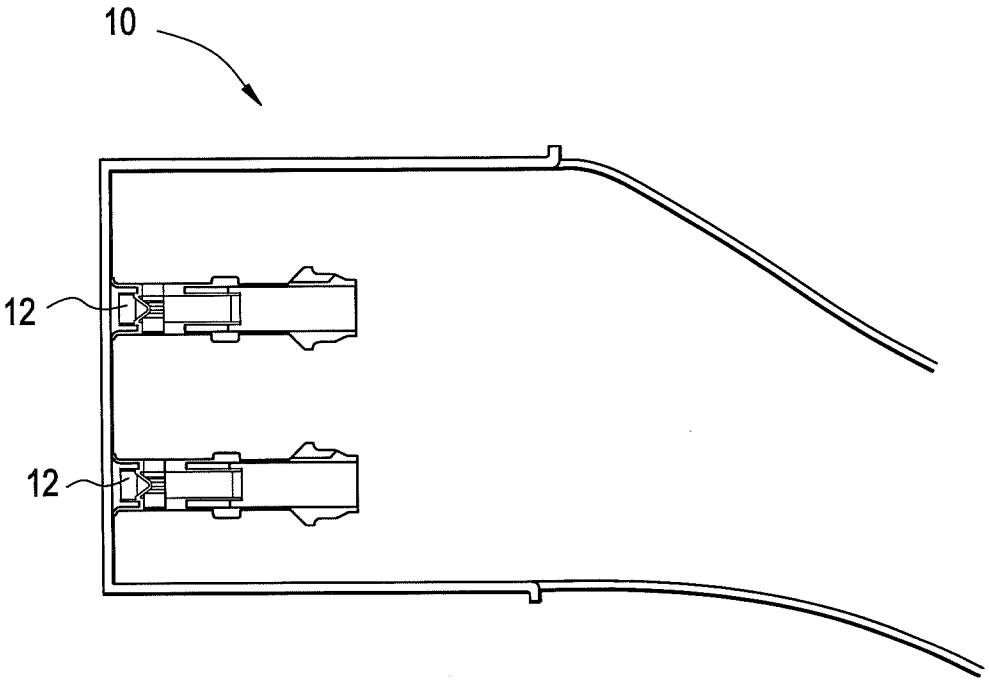
FIG. 1 is a cross-sectional view of an embodiment of a combustor.
Figure 2:
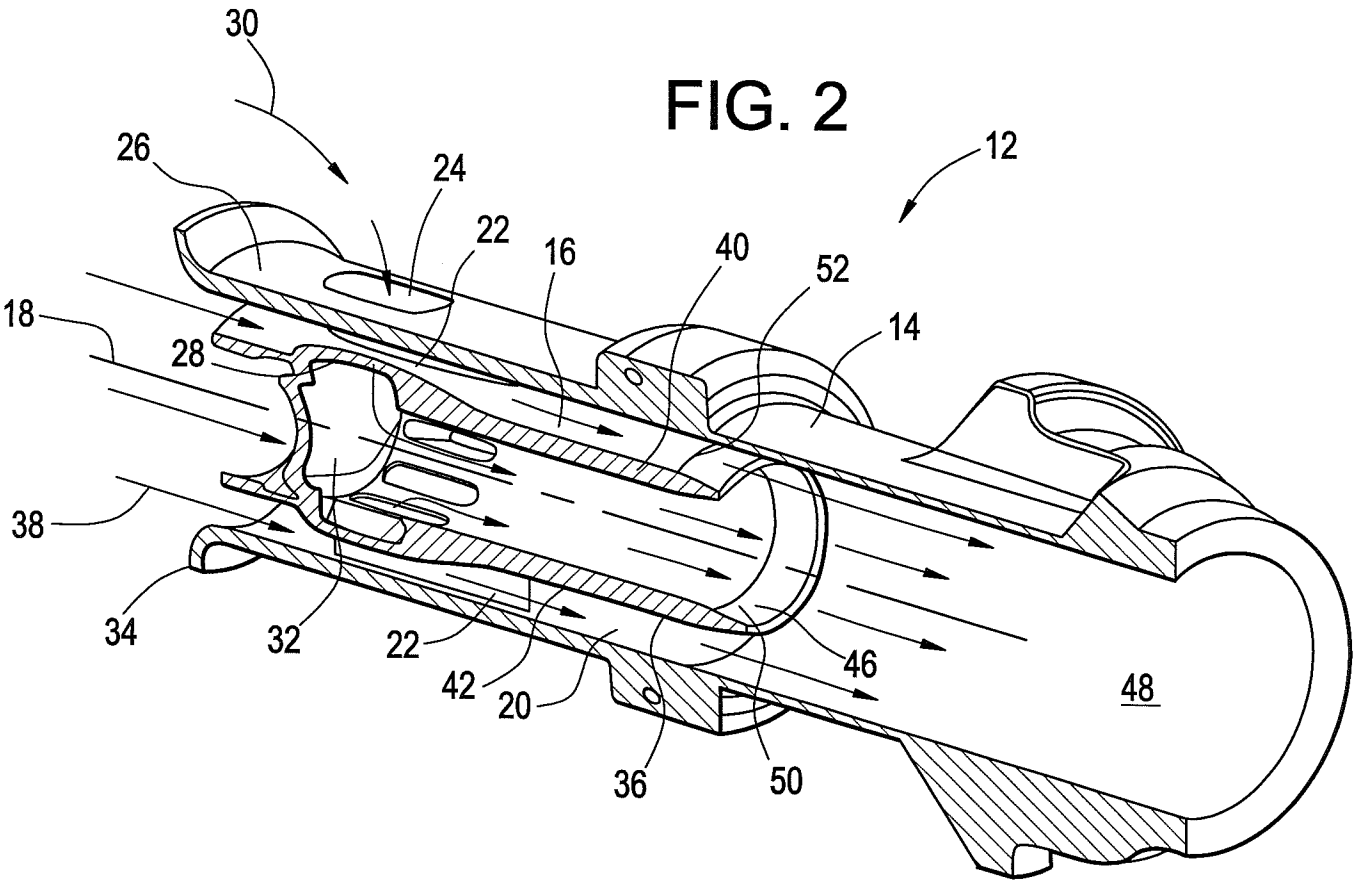
FIG. 2 is a cross-sectional view of an embodiment of a premixer of a combustor.

Shown in FIG. 1 is en embodiment of a combustor 10 including at least one premixer 12. As shown in FIG. 2, the premixer 12 includes an outer shell 14 and an inner shell 16. The inner shell 16 and outer shell 14 may be substantially annular in shape and, as shown in FIG. 2, the outer shell 14 and the inner shell 16 may be substantially concentric about a premixer axis 18. The inner shell 16 is disposed inside of the outer shell 14 such that an outer air passage 20 is defined between the inner shell 16 and the outer shell 14.

A plurality of struts 22 extend inwardly from the outer shell 14 to the inner shell 16 to support the inner shell 16 inside of the outer shell 14. Each strut 22 is hollow, or includes at least one inlet air passage 24 that extends therethrough. The inlet air passage 24 extends from an outer shell exterior 26 to an inner shell interior 28, thus allowing an inner airflow 30 to flow from the outer shell exterior 26 to the inner shell interior 28. The inner shell 16 includes a cap 32 at an upstream end 34 to direct the inner airflow 30 entering the inner shell interior 28 toward a downstream end 36 of the inner shell 16 substantially along the premixer axis 18. Further, an outer airflow 38 flows through the outer air passage 20 past the plurality of struts 22 toward the downstream end 36. The inner shell 16 includes a plurality of fuel passages 40 disposed and configured to guide a fuel flow 42 from a fuel source (not shown) to a fuel discharge annulus 46 where the fuel flow 42 is injected into a mixing area 48. The fuel passages 40 are disposed between an inner wall 50 and an outer wall 52 of the inner shell 16 and extend from the upstream end 34 to the downstream end 36.

Figure 3:
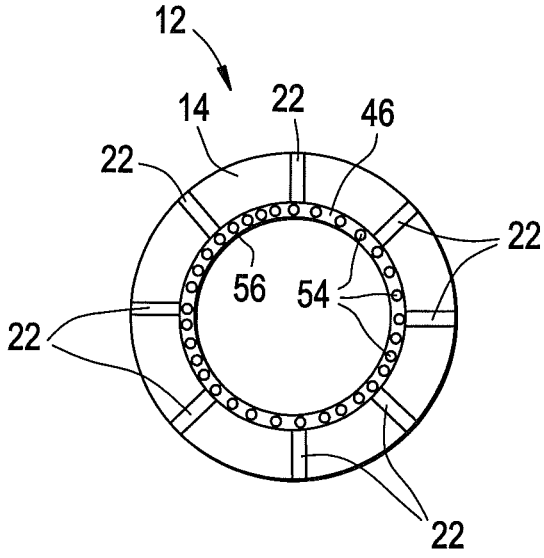
FIG. 3 is an end view of an embodiment of a premixer of a combustor.
Figure 4:
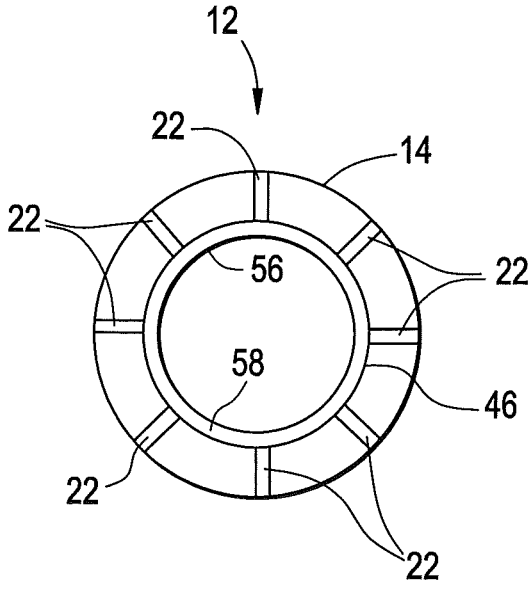
FIG. 4 is an end view of another embodiment of a premixer of a combustor.

In some embodiments, as shown in FIG. 3, the discharge annulus 46 comprises a plurality of discharge holes 54 in a tip 56 of the inner shell 16, while in other embodiments, as shown in FIG. 4, the discharge annulus 46 may comprise a continuous discharge slit 58 extending perimetrically around the tip 56. Referring again to FIG. 2, the discharge annulus 46 is configured to discharge the fuel flow 42 into the mixing area 48 substantially parallel to the premixer axis 18, and substantially parallel to both the inner airflow 30 and the outer airflow 38. The fuel flow 42 mixes with the inner airflow 30 and the outer airflow 38 in the mixing area 48. Since the fuel flow 42 is injected substantially parallel to the inner airflow 30 and the outer airflow 38, a probability of a recirculation zone forming is reduced, thus reducing incidence of operational issues with the combustor such as flameholding.

To further ensure a smooth flow of both the inner airflow 30 and the outer airflow 38 into the mixing area 48, the struts 22 are disposed such that they are at a distance sufficiently upstream of the discharge annulus 46 so that any flow disturbances caused by the struts 22 are dampened out before the inner airflow 30 and the outer airflow 38 reach the mixing area 48. Further, the struts 22 may have an aerodynamically streamlined shape to minimize flow disturbances.

Figure 5:
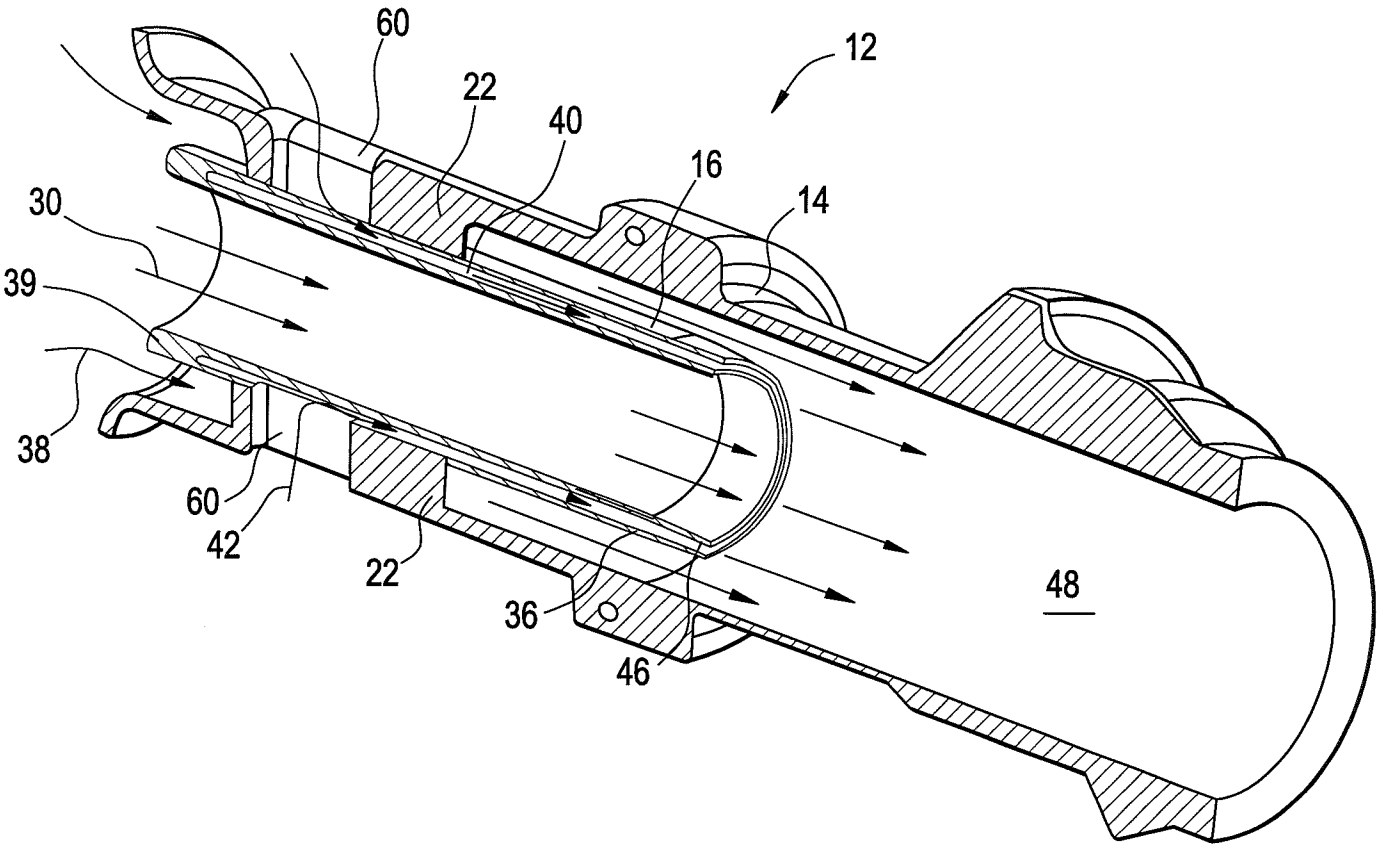
FIG. 5 is a cross-sectional view of yet another embodiment of a premixer of a combustor.

In another embodiment, as shown in FIG. 5, the plurality of struts 22 are configured to connect the fuel source to the plurality of fuel passages 40 via a plurality of strut fuel guides 60. The fuel flow 42 is guided from the fuel source through the plurality of struts fuel guides 60 and into the fuel passages 40 where it then is discharged from the discharge annulus 46 into the mixing area 48. In this embodiment, the inner shell 16 is opened at both the upstream end 34 and the downstream end 36, so that both the inner airflow 30 and the outer airflow 38 flow substantially axially from the upstream end 34 toward the downstream end 36 thus reducing flow disturbances.

Figure 6:
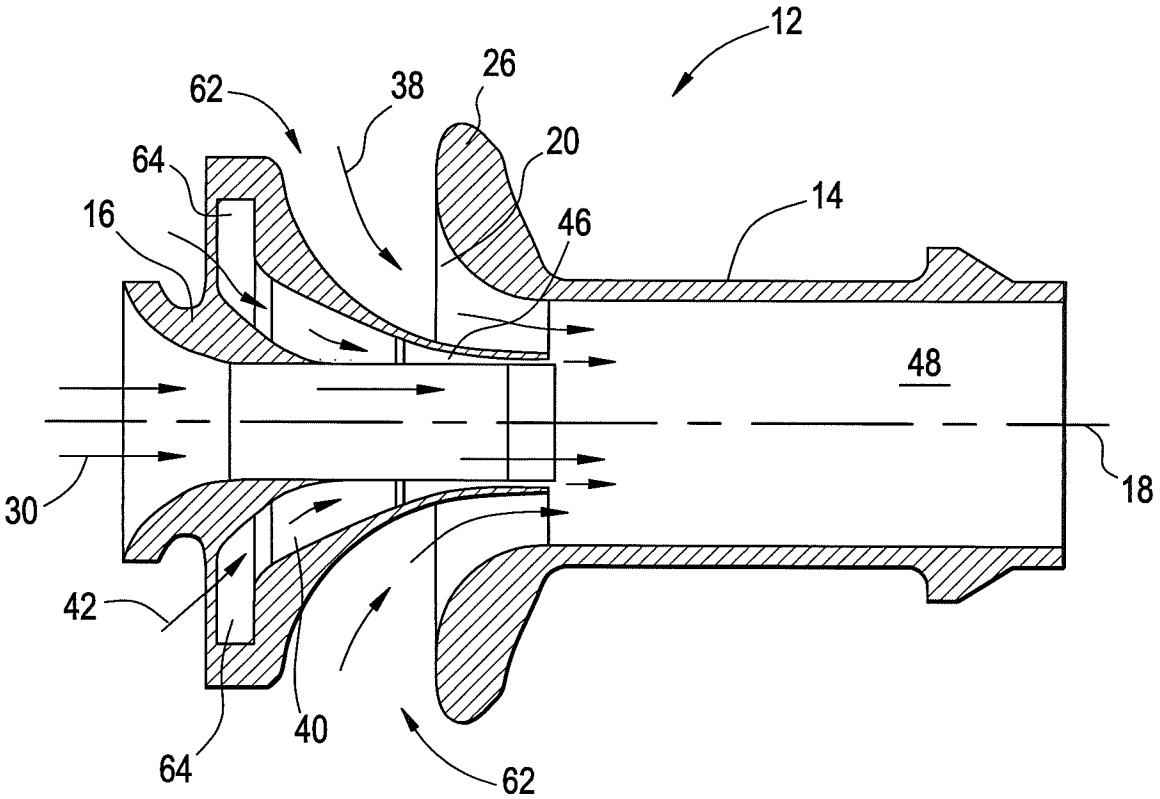
FIG. 6 is a cross-sectional view of still another premixer of a combustor.

Shown in FIG. 6 is yet another embodiment of a premixer 12. In this embodiment, a plurality of outer air passage inlets 62 are disposed at the outer shell exterior 26 and in some embodiments are disposed such that the outer airflow 38 enters the outer air passage 20 in a substantially radial direction. The outer air passage 20 is curved from the radial direction to an axial direction, thus turning the outer airflow 38 from a radially-directed flow to an axial directed flow before it enters the mixing area 48. Similarly, a plurality of fuel passage inlets 64 are disposed upstream of the outer air passage inlets 62. The fuel passage inlets 64 direct the fuel flow 42 toward the discharge annulus 46. Because the fuel passage inlets 64 are disposed upstream of the outer air passage inlets 62, the fuel passages 40 do not cross the outer air passages 20, thus struts 22 are not required. Constructing the premixer 12 without utilizing struts 22 further alleviates potential flow disturbances thereby improving premixer and combustor operability.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A premixer for a combustor comprising:

an annular outer shell;

an annular inner shell defining cylindrical inner flow channel inside of the inner shell and disposed to define an outer flow channel between the outer shell and the inner shell;

a fuel discharge annulus disposed between the outer flow channel and the inner flow channel, wherein an exit of the fuel discharge annulus is substantially concentric with an exit of the inner flow channel, the fuel discharge annulus configured to inject a fuel flow into a mixing area in a direction substantially parallel to an outer airflow through the outer flow channel and an inner air flow through the inner flow channel; and a plurality of struts extending across the outer flow channel configured to convey one of the inner airflow or the fuel flow across the outer flow channel.

2. The premixer of claim 1 wherein the plurality of struts are configured to deliver the inner airflow into the inner flow channel.

3. The premixer of claim 1 wherein the plurality of struts are configured to deliver fuel toward the fuel discharge annulus.

4. The premixer of claim 1 wherein the inner shell includes a plurality of fuel passages configured to deliver the fuel flow to the fuel discharge annulus.

5. The premixer of claim 1 wherein the fuel discharge annulus comprises a plurality of fuel discharge holes through which the fuel flow is injected into the mixing area.

6. The premixer of claim 1 wherein the fuel discharge annulus comprises a perimetrical slot through which the fuel flow is injected into the mixing area.

7. The premixer of claim 1 wherein the outer airflow enters the outer airflow channel in a substantially axial direction.

8. The premixer of claim 1 wherein the outer airflow enters the outer airflow channel in a substantially radial direction.

9. The premixer of claim 1 wherein the inner airflow enters the inner airflow channel in a substantially axial direction.

10. A combustor for a turbomachine comprising:

a plurality of premixers, each premixer including:

an annular outer shell;

an annular inner shell defining a cylindrical inner flow channel inside of the inner shell and disposed to define an outer flow channel between the outer shell and the inner shell;

a fuel discharge annulus disposed between the outer flow channel and the inner flow channel, wherein an exit of the fuel discharge annulus is substantially concentric with an exit of the inner flow channel, the fuel discharge annulus configured to inject a fuel flow into a mixing area in a direction substantially parallel to an outer airflow through the outer flow channel and an inner air flow through the inner flow channel; and a plurality of struts extending across the outer flow channel configured to convey one of the inner airflow or the fuel flow across the outer flow channel.

11. The combustor of claim 10 wherein the plurality of struts are configured to deliver the inner airflow into the inner flow channel.

12. The combustor of claim 10 wherein the plurality of struts are configured to deliver fuel toward the fuel discharge annulus.

13. The combustor of claim 10 wherein the fuel discharge annulus comprises a plurality of fuel discharge holes through which the fuel flow is injected into the mixing area.

14. The combustor of claim 10 wherein the fuel discharge annulus comprises a perimetrical slot through which the fuel flow is injected into the mixing area.

15. A method of premixing air and fuel in a combustor comprising:

flowing an outer airflow along an outer airflow channel toward a mixing area;

flowing an inner airflow along a cylindrical inner airflow channel toward the mixing area, the inner airflow channel defined by an annular inner shell;

flowing one of the inner airflow or a fuel flow across the outer airflow channel;

injecting the fuel flow into the mixing area from a fuel discharge annulus disposed between the inner airflow channel and the outer airflow channel, wherein an exit of the fuel discharge annulus is substantially concentric with an exit of the inner airflow channel, the fuel injected into the mixing area in a direction substantially parallel to the inner airflow and the outer airflow; and mixing the inner airflow, the outer airflow, and the fuel in the mixing area.

16. The method of claim 15 including supplying the inner airflow to the inner airflow channel via a plurality of struts extending across the outer airflow channel.

17. The method of claim 15 including supplying the fuel flow to the fuel discharge annulus via a plurality of struts extending across the outer airflow channel.

18. The method of claim 15 the fuel is injected into the mixing area via a perimetrical slot in the fuel discharge annulus.

* * * * *